US008573439B2

(12) United States Patent
Alvares et al.

(10) Patent No.: US 8,573,439 B2
(45) Date of Patent: Nov. 5, 2013

(54) SHEET METAL CONTAINER WITH HERMETICALLY AFFIXED END WALLS

(75) Inventors: Antonio Carlos Teixeira Alvares, Sao Paulo (BR); Silverio Candido da Cunha, Lajeado (BR)

(73) Assignee: Brasilata S.A. Embalagens Metalicas, Sao Paulo (BR)

( * ) Notice: Subject to any disclaimer, the term of this patent is extended or adjusted under 35 U.S.C. 154(b) by 217 days.

(21) Appl. No.: 12/737,666

(22) PCT Filed: Aug. 12, 2009

(86) PCT No.: PCT/BR2009/000251

§ 371 (c)(1),
(2), (4) Date: Mar. 29, 2011

(87) PCT Pub. No.: WO2010/017611

PCT Pub. Date: Feb. 18, 2010

(65) Prior Publication Data

US 2011/0168730 A1 Jul. 14, 2011

(30) Foreign Application Priority Data

Aug. 14, 2008 (BR) ..... 0802456

(51) Int. Cl.
*B65D 25/28* (2006.01)

(52) U.S. Cl.
USPC ..... 220/795; 220/916

(58) Field of Classification Search
USPC ..... 220/795, 916, 766, 790, 801, 803, 220/212.5, 378, 672, 610, 614; 229/93
See application file for complete search history.

(56) References Cited

U.S. PATENT DOCUMENTS

| | | | | |
|---|---|---|---|---|
| 1,045,055 A * | 11/1912 | Mittinger, Jr. | ..... | 220/309.2 |
| 2,268,303 A | 12/1941 | Punte | ..... | 220/59 |
| 3,616,962 A * | 11/1971 | Phipps | ..... | 220/789 |

FOREIGN PATENT DOCUMENTS

| | | |
|---|---|---|
| DE | 718 871 | 3/1942 |
| EP | 1 825 936 A2 | 8/2007 |
| GB | 667220 | 2/1952 |
| GB | 2227223 A | 7/1990 |

* cited by examiner

*Primary Examiner* — Steven A. Reynolds
*Assistant Examiner* — King M Chu
(74) *Attorney, Agent, or Firm* — Harrington & Smith

(57) ABSTRACT

The arrangement is applied to a container which includes a peripheral side wall having an upper end portion and a lower end portion in which are applied respective end walls, each including a median panel and a peripheral skirt, one of the upper end portion and lower end portion and the peripheral skirt being provided with at least one circumferential rib turned to the other of said parts, the other part being provided with a circumferential groove conformed to be fitted onto the circumferential rib upon the fitting of said end wall in the interior of one of the upper end portion and lower end portion of the peripheral side wall, said circumferential rib and circumferential groove forming, therebetween, a circumferential gap (F) in the interior of which is compressed an elastic sealing element.

13 Claims, 5 Drawing Sheets

SHEET METAL CONTAINER WITH HERMETICALLY AFFIXED END WALLS

FIELD OF THE INVENTION

The present invention refers to a closure arrangement to be applied in containers formed in metal sheet, such as closed pails or other containers which comprise a peripheral side wall, presenting a cylindrical form or an inverted and slightly frusto-conical form and having an upper end portion and a lower end portion, in which are attached respective end walls.

PRIOR ART

The containers of the type considered herein have their upper and lower end walls respectively and peripherally double-seamed in the upper end portion and lower end portion of the peripheral side wall, the upper end wall being provided with a generally eccentric opening having a contour substantially smaller than that of the peripheral side wall, and with a gripping handle contained in the interior of the axial projection of the contour of the container for allowing the latter to be lifted by the gripping handle attached only on the upper end wall. The opening provided on the upper end wall is configured to define a seat in which is applied a lip generally formed in a plastic material.

Due to the complexity of the double-seaming processes, which require the use of specific and expensive equipment, these double-seaming phases in the manufacture of the containers considered herein are rarely carried out in the facilities of the filling company (filler) of the product to be commercialized stored in these containers.

Thus, the containers are closed in the manufacture's facilities, by double-seaming the end walls in the peripheral side wall, being then shipped to the facilities of the company responsible for filling the product to be commercialized. Since the containers are shipped with the end walls already double-seamed in the peripheral side wall, they cannot be fitted one inside the other, requiring to be arranged side-by-side and stacked in transport vehicles and also in the storage places, both at the container manufacturer and at the fillers, requiring a physical space presenting an undesirable large volume in relation to the mass of the material, considerably increasing the shipping and storage costs and requiring special cares to transport these containers.

Another drawback of these containers supplied to the filler with the end walls already attached, generally by double-seaming, results from the fact that the filling can be only carried out through the opening of reduced dimension provided in the upper end wall. Thus, the time for filling the product is longer than that corresponding to the filling carried out without the upper end wall, as it occurs upon filling containers which are superiorly closed by a removably lid and provided with a suspension handle applied to the peripheral side wall and not to the lid.

SUMMARY OF THE INVENTION

Due to the inconveniences mentioned above, it is an object of the present invention to provide a closure arrangement for containers in metal sheet, having a peripheral side wall, a lower end wall and an upper end wall provided with a small discharge opening and with a suspension handle and which upper end wall can be easily, quickly, reliably and hermetically affixed to the peripheral side wall by the filler of the product to be packaged, without requiring any double-seaming operation. It is a further object of the present invention to provide a closure arrangement for a container as defined above, which has its peripheral side wall configured to be partially and telescopically fitted in the interior of the peripheral side wall of another container generally disposed under the first container upon stacking.

In order to attain the object mentioned above, the invention proposes a closure arrangement, according to which at least one of the two end walls comprises a median panel and a peripheral skirt projecting axially outwardly, one of the parts defined by one of the upper end portion and lower end portion and by the peripheral skirt of the adjacent end wall being provided with at least one circumferential rib turned to the other of said parts, the other part being provided with a circumferential groove defined between two face portions and conformed to be fitted onto the circumferential rib, upon the fitting of said end wall in the interior of one of the upper end portion and lower end portion of the peripheral side wall and upon the seating of the face portions of said other part against the first of said parts, said circumferential rib and circumferential groove presenting confronting median portions which are radially spaced to form, therebetween, a circumferential gap, in the interior of which is compressed an elastic sealing element.

With the proposed construction, one or both end walls can be fitted and hermetically and reliably affixed to the peripheral side wall, without requiring costly and complex double-seaming operations. Thus, the containers can be manufactured and sent to the filler with the upper end walls or, optionally, with the lower end walls still separated from the peripheral side wall and to be affixed thereto by the filler. In this case, the other end wall, either lower or upper, can be equally fitted and affixed to the respective end portion of the peripheral side wall by the container manufacturer or attached by double-seaming, before being shipped to the filler.

In the solution proposed herein, the filler can use the whole cross section of one of the end portions, generally the upper, to carry out the filling of the product, reducing the operation time, before providing the fitting and retention of the respective end wall in the interior of the peripheral side wall, by means of a simple compression operation.

In case the peripheral side wall is constructed so as to be tapered from one end portion to the other, generally from the upper end portion to the lower end portion, in a continuous or stepped manner, the containers can be stored and shipped without the upper end wall and in a condition in which they remain partially fitted one inside the other in stacks, allowing a great economy in storage and transportation volume until they are closed at the filler's facilities, preferably after the filling operation.

BRIEF DESCRIPTION OF THE INVENTION

The invention will be described below, with reference to the enclosed drawings, given by way of example of one of the possible embodiments of the invention and in which.

DETAILED DESCRIPTION OF THE INVENTION

Figure 1:
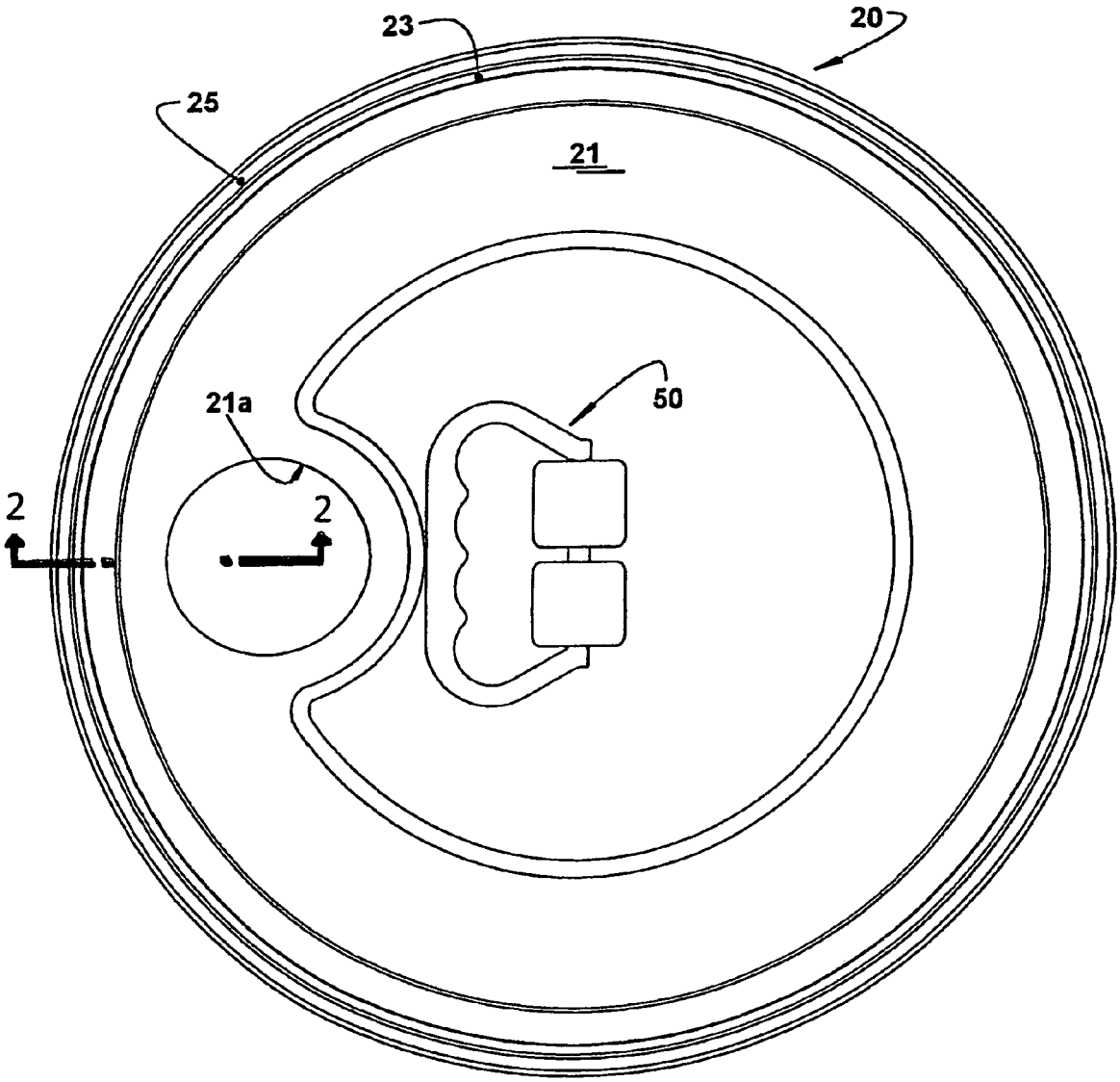
FIG. 1 represents a top plan view of the present container, with its peripheral side wall presenting a circular contour.
Figure 2:
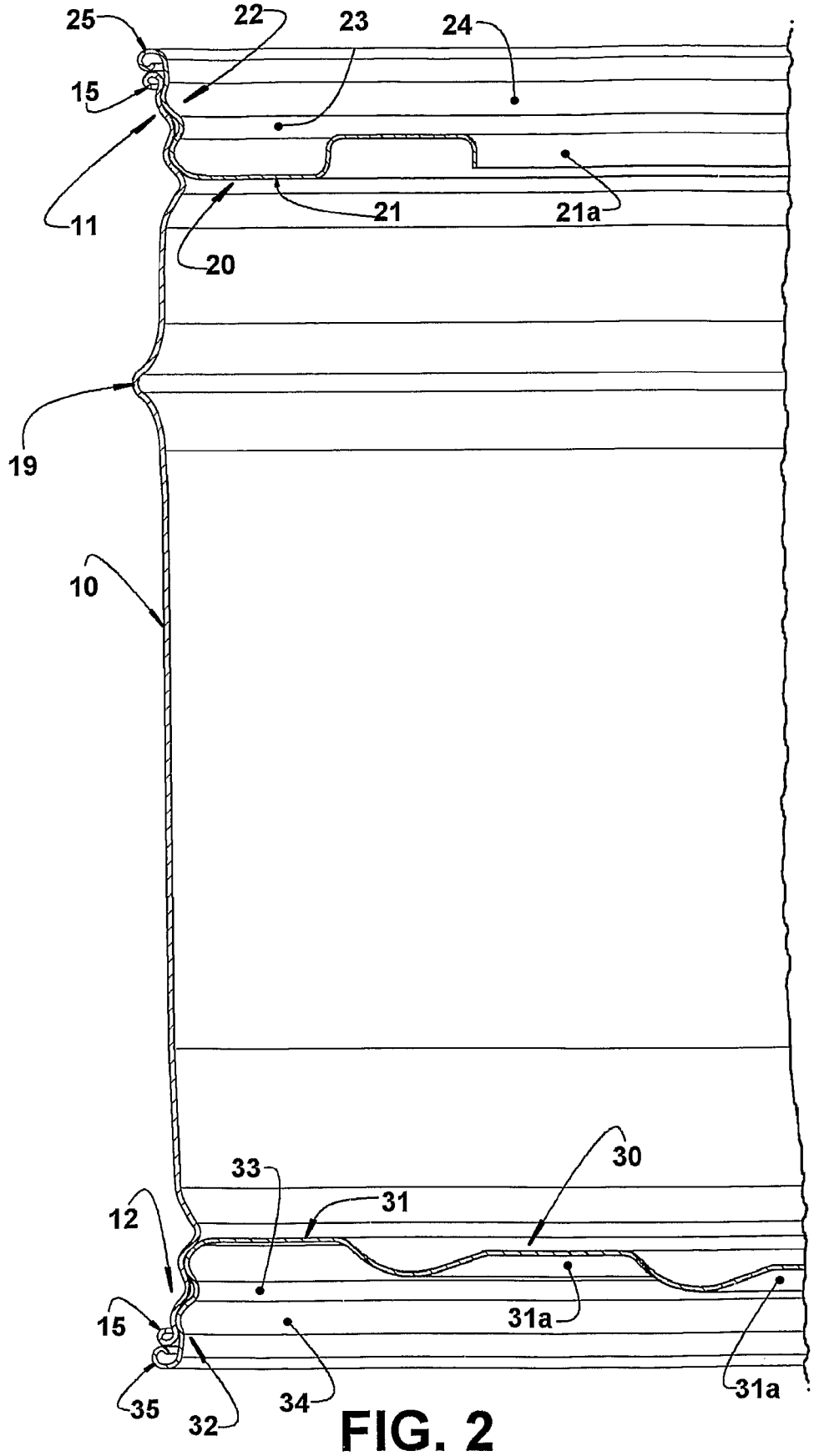
FIG. 2 represents a partial diametrical sectional view of the container, said section taken according to line II-II in FIG. 1.
Figure 3:
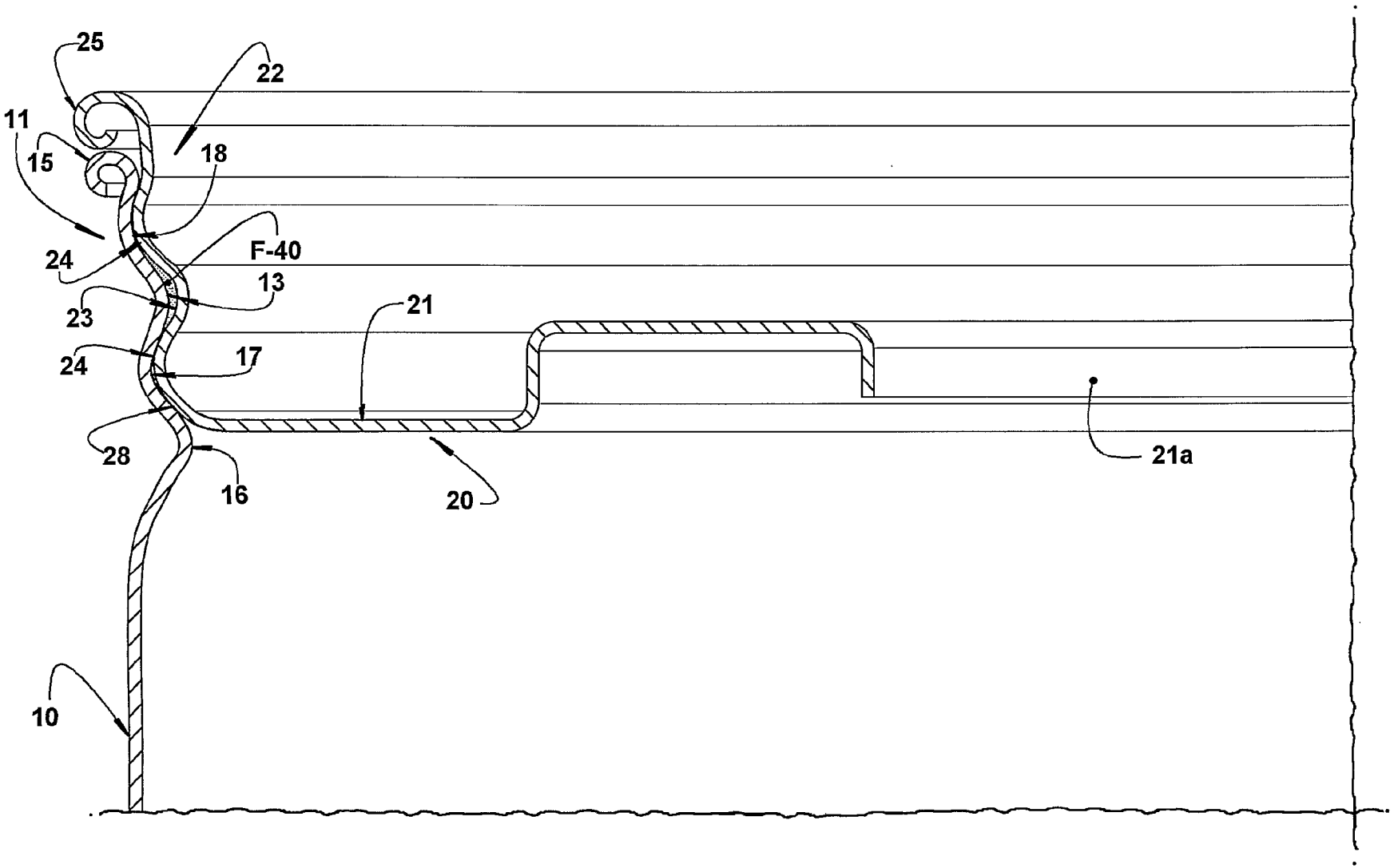
FIG. 3 represents an enlarged detail of the region of FIG. 2 which illustrates the fitting of the end wall upper in the upper end portion of the peripheral side wall.
Figure 4:
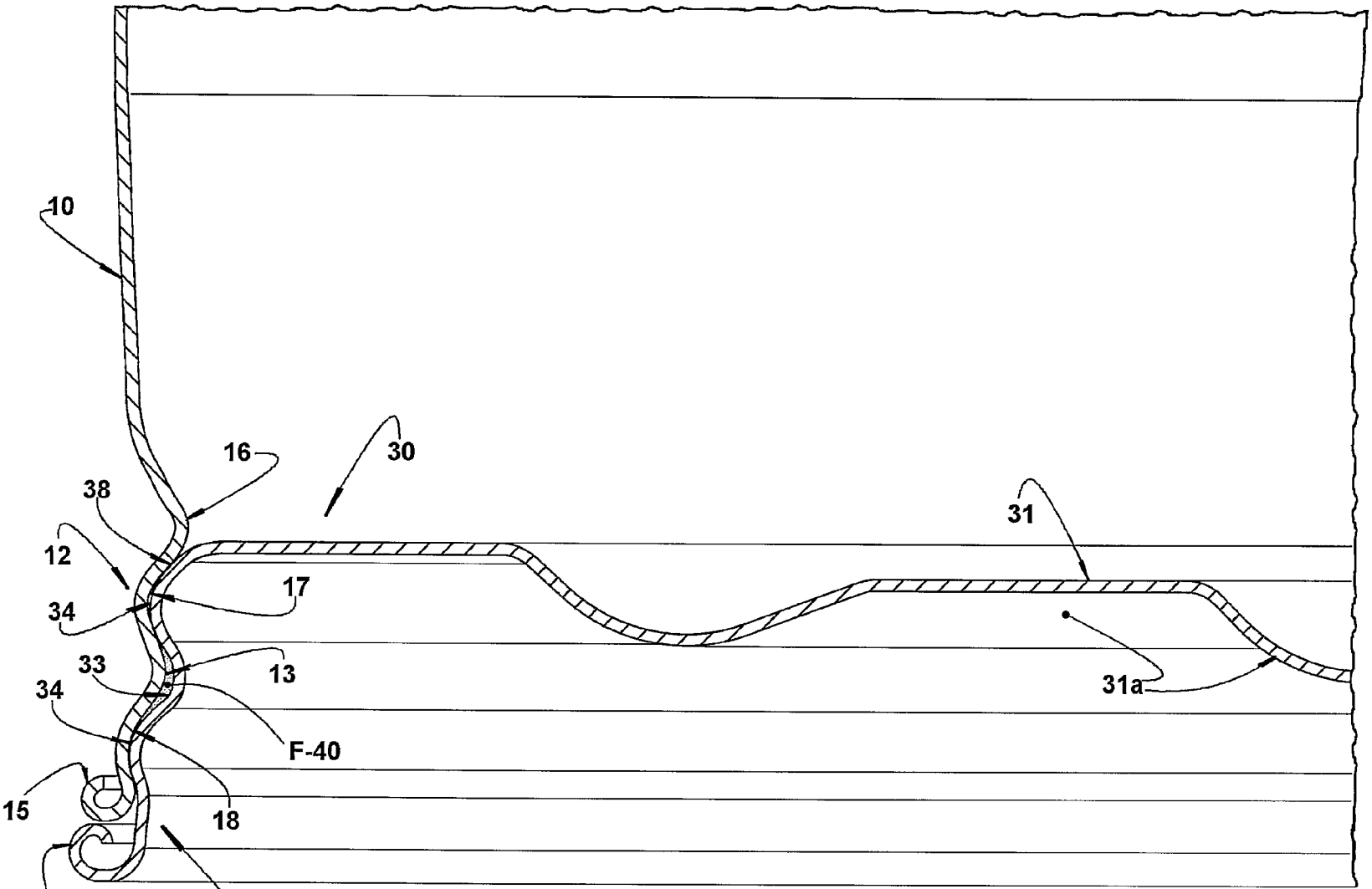
FIG. 4 represents an enlarged detail of the region of FIG. 2 which illustrates the fitting of the end wall lower in the lower end portion of the peripheral side wall.

The present closure arrangement is applied to a container formed in a metal sheet, usually tinplate, and comprising a peripheral side wall 10, forming a tubular body with any polygonal cross section, but usually circular and having an upper end portion 11 and a lower end portion 12 in which are respectively fitted and retained an upper end wall 20 and a lower end wall 30.

According to the drawings, the upper end wall 20 and lower end wall 30 comprise a median panel 21, 31, optionally provided with stiffening circumferential flanges 31*a* and with a peripheral skirt 22,32 projecting axially outwardly and which is configured to be tightly fitted, under strong interference, in the interior of the upper end portion 11 and lower end portion 12, respectively, of the peripheral side wall 10.

In order to obtain a reliable and hermetic retention of the end walls 20,30 in the interior of the peripheral side wall 10, each of the upper end portion 11 and lower end portion 12 is provided with at least one circumferential rib 13 turned radially inwardly, that is, turned to the adjacent peripheral skirt 22,32 of the respective end wall 20,30, whilst each of the two peripheral skirts 22,32 is provided with a circumferential groove 23,33, defined between two face portions 24,34 of the respective peripheral skirt 22,32 and conformed to be fitted onto the circumferential rib of the adjacent upper end portion 11 or lower end portion 12, upon the fitting of each of said end wall 20,30 in the interior of one of the respective upper end portion 11 and lower end portion 12 of the peripheral side wall 10 and upon the seating of the face portions 24,34 of each peripheral skirt 22,32 against respective confronting face portions of each of the respective upper end portion 11 and lower end portion 12 of the peripheral side wall 10.

The circumferential rib 13 of each of the upper end portion 11 and lower end portion 12 of the peripheral side wall 10 presents a median portion confronting with and radially spaced from a median portion of a respective circumferential groove 23,33, in order to form therebetween a circumferential gap F, in the interior of which is compressed an elastic sealing element 40, generally defined by a rib made of elastomeric material, for example plastisol, which is applied inside each of the circumferential grooves 23,33 before fitting each end wall 20,30 in the interior of the peripheral side wall 10.

As illustrated, the sealing element 40 remains compressed in the interior of the circumferential gap F, without escaping axially inwardly or outwardly from the container upon the seating of the face portions 24,34 of each peripheral skirt 22,32 against respective face portions of the confronting upper end portion 11 or lower end portion 12 of the peripheral side wall 10.

In the preferred construction illustrated in the drawings, each of the upper end portion 11 and lower end portion 12 is provided with two circumferential ribs 13,16 axially spaced and forming therebetween an intermediary face portion 17 internal to the peripheral side wall 10. In this construction, the axially outermost circumferential rib 13 of each of the upper end portion 11 and lower end portion 12 is fitted into the circumferential groove 23,33 of the confronting peripheral skirt 22,32, so as to form the circumferential gap F, upon the seating of the intermediary face portion 17 of each of the upper end portion 11 and lower end portion 12 of the peripheral side wall 10 against a confronting face portion 24,34 of the peripheral skirt 22,32 of each end wall 20,30.

The axially innermost circumferential rib 16, on its turn, is configured to be seated against a retention portion 28,38 of each of the end walls 20,30, at least in order to provide a deeper penetration of the end wall 20,30 in the interior of the peripheral side wall 10.

Although the illustrated construction presents two circumferential ribs 13,16 in each of the upper end portion 11 and lower end portion 12 of the peripheral side wall 10 and a circumferential groove 23,33 in the peripheral skirt 22,32 of the end walls 20,30, it should be understood that the number of circumferential ribs 13,16 can be even greater, with at least one circumferential rib 13 forming a circumferential gap F with a confronting grove 23,33 of each of the end walls 20,30.

It should be further observed that the circumferential ribs 13,16 can be provided in the peripheral skirt 22,32 of the end walls 20,30, with the circumferential grooves 23,33 being provided in the upper end portion 11 and lower end portion 12 of the peripheral side wall 10. It should also be observed that both the circumferential ribs and the circumferential grooves can be provided in both parts defined by the peripheral skirts 22,32 and by the upper end portion 11 and lower end portion 12 of the peripheral side wall 10, although the illustrated embodiment provides two circumferential ribs 13,16 provided in each of the upper end portion 11 and lower end portion 12 of the peripheral side wall 10 and radially projecting in the same direction.

Considering that the container is formed in metal sheet, both the circumferential ribs 13,16 and the circumferential grooves 23,33 are preferably obtained by deforming the metal sheet of the respective parts of the container and conformed to present a cross section in the approximate form of a rounded V, formed in convex and concave arcs, respectively.

In the illustrated embodiment, the upper end portion 11 and lower end portion 12 of the peripheral side wall 10 and the peripheral skirt 22,32 of each end wall 20,30 present, each one, an outwardly and inwardly bent end edge forming, in each of the parts cited above, a finishing tubular rib 15,25,35.

Generally, the tubular rib 25,35 of the end edge of the peripheral skirt 22,32 of each of the end walls 20,30 is seated against a respective tubular rib 15 of the peripheral side wall 10, upon the fitting of the end walls 20,30 in the interior of the latter.

As already previously mentioned, the filling of the product can be facilitated and accelerated when executed through one of the ends of the container deprived of the respective end wall, generally the upper one. In this case, it is only necessary that the end wall, to be closed after the filling operation, is constructed according to the present invention and the other end wall can be attached to the peripheral side wall by any adequate means, for example using double-seaming during the manufacture of the container. Thus, the circumferential rib or the circumferential ribs 13,16 can be provided in one or in both the upper end portion 11 and lower end portion 12 of the peripheral side wall 10 or in the peripheral skirt 22,32 of one or both the end walls 20,30.

In the illustrated embodiment, the circumferential ribs 13,16 project radially inwardly the respective upper end portion 11 or lower end portion 12 of the peripheral side wall 10, the circumferential groove 23,33 being externally provided in the peripheral skirt 22,32 of the respective end wall 20,30.

Further according to the preferred and illustrated construction, the axially innermost face portion 24,34 presents an externally convex arched profile, to be seated against the intermediary face portion 17 of the respective end portion 11,12 of the peripheral side wall 10, which intermediary face portion 17 presents an internally concave arched profile. This constructive arrangement allows these mutually seating face portions around the region of the circumferential gap F to work not only as retention means against undue axial displacement of the sealing element 40, but also as retention means for the auxiliary mechanical axial locking between the peripheral side wall 10 and the end walls 20,30 when these are constructed and affixed according to the present invention. However, it should be understood that these mutually seating face portions need not be compulsorily arched to define effective axial retention means between the end walls 20,30 and the peripheral side wall 10.

Further according to the illustrated embodiment, the retention portion 28,38 is defined by a peripheral marginal region of the median panel 21,31 of the end wall 20,30, axially seated under the axially innermost circumferential rib 16. In this constructive arrangement, the axially innermost circumferential rib 16, which is provided in at least one of the upper end portion 11 and lower end portion 12 of the peripheral side wall 10, operates as a kind of stop, defining a concave circumferential cradle against which is axially seated said peripheral marginal region of the median panel 21,31 of each end wall, limiting the axial displacement of said end walls 20,30 towards the interior of the container. Aiming at increasing even more the mechanical axial locking between the peripheral side wall 10 and each of the end walls 20,30 constructed according to the present invention, the axially outermost face portion 24,34 presents an arched profile, which is externally convex in the radial direction, to be seated against an end face portion 18, in an internally concave arched profile of the respective end portion 11,12 of the peripheral side wall 10.

As already mentioned, the present constructive solution is particularly adequate to be applied in containers in which the median panel 21 of the superiorly disposed end wall 20 is provided with a generally eccentric opening 21*a* of smaller diameter, and also with a gripping handle generally positioned in the central region of said upper end wall 20, the gripping handle 50 being integrally affixed in said end wall 20, so as to allow the container, even if full, to be lifted by said gripping handle 50. In this type of construction, the smaller diameter opening 21*a* is usually closed by a removable lid, preferably constructed in a plastic material and which is not illustrated herein since it forms no part of the present invention.

As already previously mentioned and also illustrated in FIG. 6 of the enclosed drawings, the peripheral side wall 10 of the container can be constructed to allow the partial telescopic fitting between two stacked containers. The illustrated embodiment has an inverted and slightly frusto-conical form, the smaller base coinciding with the lower end wall 30 and the larger base being preferably situated in a plane axially spaced back in relation to the mounting plane of the upper end wall 20 in which the peripheral side wall 10 is deformed to define an outer circumferential projection 19.

Figure 5:
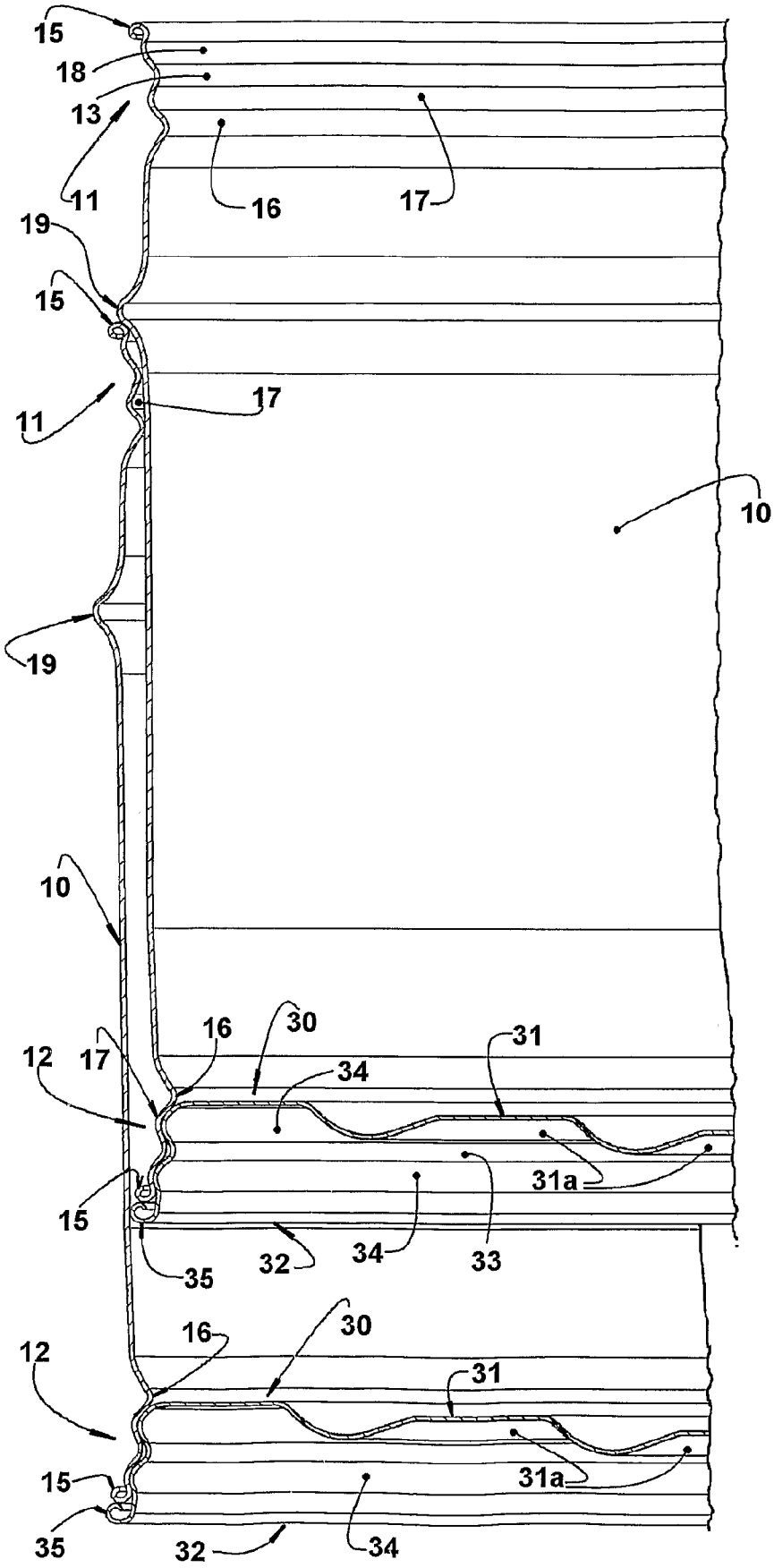
FIG. 5 represents a partial diametrical sectional view of two containers deprived of the upper end wall and partially fitted one into the other.

With this construction, a container can be telescopically fitted inside another inferiorly disposed container deprived of the upper end wall. This fitting, illustrated in FIG. 5, is carried out until the outer circumferential projection 19 is seated onto the free edge of the upper end portion 11 of the peripheral side wall 10, allowing the containers thus stacked to occupy a total volume which is substantially inferior to the volume that would be occupied with the same number of inferiorly and superiorly closed containers stacked one on top of the other. With this partial fitting arrangement, the containers can be stored and shipped with a great economy in volume and, accordingly, in cost. While only one embodiment of the invention has been illustrated herein, it should be understood that the present closure arrangement can suffer alterations in the form and physical arrangement of its component parts, without departing from the constructive concept defined in the claims that accompany the present specification.

The invention claimed is:

1. A closure arrangement for a container in metal sheet, comprising a peripheral side wall having an end portion in which is applied an end wall, the arrangement being characterized in that the end wall comprises a median panel and a peripheral skirt projecting axially outwardly, one of the end portion and the peripheral skirt being provided with a circumferential rib turned to the other of the peripheral skirt and the end portion, and where in the other of the end portion and peripheral skirt being provided with a circumferential groove defined between two face portions and conformed to be fitted onto the circumferential rib, upon the fitting of the end wall in an interior of the end portion of the peripheral side wall and upon the seating of the face portions of the peripheral skirt against the end portion, the circumferential rib and circumferential groove presenting confronting median portions which are radially spaced to form, therebetween, a circumferential gap (F), in the interior of which is compressed an elastic sealing element.

2. The arrangement, as set forth in claim 1, characterized in that the circumferential rib and the circumferential groove are formed by deformation of the metal sheet of the respective end portion and peripheral skirt and present a cross section with the approximate form of a rounded V formed in convex and concave arcs, respectively.

3. The arrangement, as set forth in claim 1, characterized in that the elastic sealing element is applied in the interior of the circumferential groove before the fitting of the end wall in the interior of the peripheral side wall.

4. The arrangement, as set forth in claim 1, characterized in that at least one of the end portion of the peripheral side wall and the peripheral skirt of the adjacent end wall includes an end edge which is outwardly and inwardly bent so as to define a tubular rib in each of the end portion and the peripheral skirt.

5. The arrangement, as set forth in claim 4, characterized in that the tubular rib of the end edge of the peripheral skirt is seated against the tubular rib of the peripheral side wall, upon the fitting of the peripheral skirt in the interior of the peripheral side wall.

6. The arrangement, as set forth in claim 1, characterized in that one of the end portion of the peripheral side wall and the peripheral skirt of the end wall is provided with at least two circumferential ribs axially spaced and forming therebetween an intermediary face portion, the axially outermost circumferential rib being fitted in a respective circumferential groove of the other of the end portion and the peripheral skirt, forming the circumferential gap (F) upon the seating of the intermediary face portion of one of the end portion and the peripheral skirt against a confronting face portion of the other of the peripheral skirt and the end portion, and the axially innermost circumferential rib of one of the end portion and the peripheral skirt being configured to be seated against a retention portion of the other of the peripheral skirt and the end portion, axially locking the end portion and the peripheral skirt to one another, at least in order to provide a deeper penetration of the end wall in the interior of the peripheral side wall.

7. The arrangement, as set forth in claim 6, characterized in that the at least two circumferential ribs radially project in the same direction.

8. The arrangement, as set forth in claim 7, characterized in that the circumferential ribs are provided in at least one of an upper end portion and a lower end portion of the peripheral side wall.

9. The arrangement, as set forth in claim 8, characterized in that the circumferential ribs project radially inwardly from the respective upper end portion or lower end portion of the peripheral side wall, the circumferential groove being externally provided in the peripheral skirt of the end wall.

10. The arrangement, as set forth in claim 9, characterized in that an axially innermost face portion presents an externally convex arched profile, in order to be seated against the intermediary face portion of the respective end portion of the peripheral side wall, which presents an internally concave arched profile.

11. The arrangement, as set forth in claim 10, characterized in that the retention portion is defined by a peripheral marginal region of the median panel of the end wall axially seated under the axially innermost circumferential rib.

12. The arrangement, as set forth in claim 10, characterized in that the axially outermost face portion presents an externally convex arched profile, to be seated against an end face portion, in an internally concave arched profile of the respective end portion of the peripheral side wall.

13. The arrangement, as set forth in claim 1, characterized in that the median panel of the end wall is provided with a generally eccentric smaller diameter opening and with a gripping handle.

* * * * *